US009177437B2

(12) United States Patent
Walkingstick

(10) Patent No.: US 9,177,437 B2
(45) Date of Patent: Nov. 3, 2015

(54) LOCALIZED REMOTE GAMING

(71) Applicant: IGT, Reno, NV (US)

(72) Inventor: Paul B. Walkingstick, Sparks, NV (US)

(73) Assignee: IGT, Las Vegas, NV (US)

( * ) Notice: Subject to any disclaimer, the term of this patent is extended or adjusted under 35 U.S.C. 154(b) by 123 days.

(21) Appl. No.: 13/797,588

(22) Filed: Mar. 12, 2013

(65) Prior Publication Data

US 2014/0274255 A1 Sep. 18, 2014

(51) Int. Cl.
*G07F 17/32* (2006.01)
*G07F 17/34* (2006.01)

(52) U.S. Cl.
CPC ..... *G07F 17/3225* (2013.01); *G07F 17/3223* (2013.01); *G07F 17/3244* (2013.01); *G07F 17/3293* (2013.01); *G07F 17/34* (2013.01)

(58) Field of Classification Search
CPC ..... G07F 17/3225; G07F 17/3223
USPC ..... 463/16–20, 42
See application file for complete search history.

(56) References Cited

U.S. PATENT DOCUMENTS

| | | | | |
|---|---|---|---|---|
| 4,467,424 | A | 8/1984 | Hedges et al. | |
| 6,001,016 | A | 12/1999 | Walker et al. | |
| 6,361,437 | B1 | 3/2002 | Walker et al. | |
| 6,846,238 | B2 * | 1/2005 | Wells | 463/39 |
| 6,935,952 | B2 * | 8/2005 | Walker et al. | 463/25 |
| 7,066,815 | B2 * | 6/2006 | Walker et al. | 463/23 |
| 7,112,138 | B2 * | 9/2006 | Hedrick et al. | 463/29 |
| 7,806,763 | B2 | 10/2010 | Walker et al. | |
| 2007/0232397 | A1 | 10/2007 | Katz | |
| 2008/0268959 | A1 * | 10/2008 | Bryson et al. | 463/42 |
| 2009/0104954 | A1 * | 4/2009 | Weber et al. | 463/1 |
| 2010/0240435 | A1 * | 9/2010 | Gagner et al. | 463/20 |
| 2012/0165101 | A1 * | 6/2012 | Krishnamoorthy et al. | 463/42 |
| 2013/0210511 | A1 * | 8/2013 | LaRocca et al. | 463/12 |

FOREIGN PATENT DOCUMENTS

| | | |
|---|---|---|
| EP | 1 816 617 | 8/2007 |
| WO | WO-2004/034223 | 4/2004 |
| WO | WO-2012/125604 | 9/2012 |

OTHER PUBLICATIONS

Extended European Search Report for European Application No. 14158600, dated May 26, 2014, 6 pages.

* cited by examiner

*Primary Examiner* — Michael Cuff
(74) *Attorney, Agent, or Firm* — Neal, Gerber & Eisenberg LLP

(57) ABSTRACT

A gaming machine, such as a video slot or video poker machine, may be configured to provide both in-person and remote play. A command from a remote client device is provided to the gaming machine to initiate a round of gameplay. A result of the gameplay is communicated back to the client device.

26 Claims, 4 Drawing Sheets

LOCALIZED REMOTE GAMING

BACKGROUND

1. Field of the Described Embodiments

The present disclosure relates generally to gaming machines, and more particularly to using an access service to remotely control an electronic gaming machine.

2. Description of the Related Art

Many of today's gaming casinos and other entertainment locations feature different single and multi-player gaming systems such as slot machines and video poker machines. The gaming machines may include a number of hardware and software components to provide a wide variety of game types and game playing capabilities. Exemplary hardware components may include bill validators, coin acceptors, card readers, keypads, buttons, levers, touch screens, coin hoppers, ticket printers, player tracking units and the like. Software components may include, for example, boot and initialization routines, various game play programs and subroutines, credit and payout routines, image and audio generation programs, various component modules and a random or pseudo-random number generator, among others.

Gaming machines are highly regulated to ensure fairness. In many cases, gaming machines may be operable to dispense monetary awards of a large amount of money. Accordingly, access to gaming machines is often carefully controlled. For example, in some jurisdictions, routine maintenance requires that extra personnel (e.g., gaming control personnel) be notified in advance and be in attendance during such maintenance. Additionally, gaming machines may have hardware and software architectures that differ significantly from those of general-purpose computers (PCs), even though both gaming machines and PCs employ microprocessors to control a variety of devices. For example, gaming machines may have more stringent security requirements and fault tolerance requirements. Additionally, gaming machines generally operate in harsher environments as compared with PCs.

In contrast to gaming machines located in brick and mortar gaming environments, many online gaming services are mostly or wholly unregulated. For example, an online gaming service may have servers located overseas in a country that does not regulate wager-based games. Without oversight or accountability, an unscrupulous online gaming service can falsely advertise odds to give the service an unfair advantage. A user of such a service may also be putting his or her financial information at risk, since there is no accountability for an unregulated online gaming service.

SUMMARY

In one embodiment, a method of providing remote access to a physical gaming machine located in a gaming environment is disclosed. The method includes providing a plurality of gaming machines located in the gaming environment for in-person play. The method also includes selecting, from among the plurality of gaming machines, one of the gaming machines for remote play. The method further includes communicating a command received from a client device to the selected gaming machine, the command being configured to cause the gaming machine to initiate a round of gameplay. The method also includes communicating a result of the gameplay from the gaming machine to the client device.

In another embodiment, a system for providing remote access to a physical gaming machine located in a gaming environment is disclosed. The system includes a plurality of gaming machines located in the gaming environment for in-person play. The system also includes one or more computing devices configured to select, from among the plurality of gaming machines, one of the gaming machines for remote play. The one or more computing devices are also configured to communicate a command received from a client device to the selected gaming machine, the command being configured to cause the gaming machine to initiate a round of gameplay. The one or more computing devices are further configured to communicate a result of the gameplay from the gaming machine to the client device.

In another embodiment, a system for providing remote access to a physical gaming machine located in a gaming environment is disclosed. The system includes a remote access service configured to provide a bridge between a network internal to the gaming environment and an external network located outside of the gaming environment. The system also includes a gameplay service configured to provide gaming protocol formatted commands to the gaming machine via the internal network of the gaming environment. The remote access service is configured to receive a gameplay command for the gaming machine from a client device via the external network and to forward the command to the gameplay service. The gameplay service is configured to convert the command received from the remote access service into a gaming protocol format and to send the converted command to the gaming machine via the internal network of the gaming environment.

BRIEF DESCRIPTION OF THE DRAWINGS

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

According to various embodiments disclosed herein, computing devices in a gaming environment may be configured to allow a remote user to control a gaming machine located within the gaming environment. For example, a casino may implement a remote access service that allows a client device located outside of the casino to control a slot machine physically located within the casino. In other words, the gaming machine can be controlled remotely in the same manner as if the player were physically operating the machine itself. If the gaming environment is located in a jurisdiction that regulates wager-based gaming, the player can rely on the fact that the remotely controlled gaming machine conforms to the local gaming laws (e.g., laws that dictate a minimum payout by the machine, laws that control how a bonus round is played, etc.). The player may also have certain assurances regarding the security of their financial information when remotely gaming through a reputable casino or other entity. In various implementations, the player's financial information may only be accessible by devices on the local network of the gaming environment, thereby preventing access to the player's financial information by devices located outside of the environment.

Figure 1:
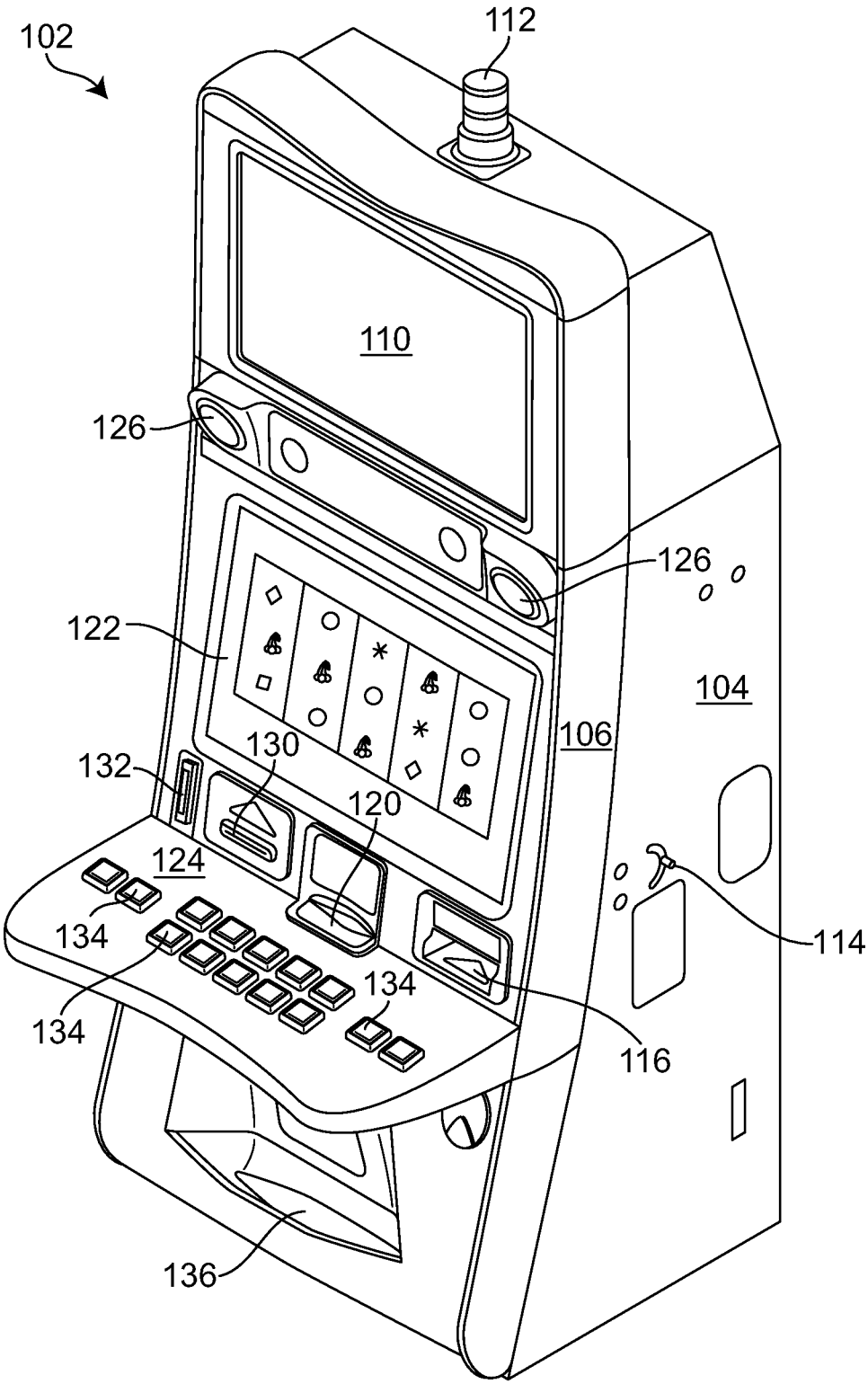
FIG. 1 is an illustration of a gaming machine, according to an exemplary embodiment.

Referring to FIG. 1, a perspective drawing of an electronic gaming machine 102 is shown in accordance with described embodiments. Gaming machine 102 may include a main cabinet 104. Main cabinet 104 may provide a secure enclosure that prevents tampering with device components, such as a game controller (not shown) located within the interior of main cabinet 104. Main cabinet 104 may include an access mechanism, such as a door 106, which allows the interior of gaming machine 102 to be accessed. Actuation of a door 106 may be controlled by a locking mechanism 114. In some embodiments, locking mechanism 114, door 106, and the interior of main cabinet 104 may be monitored with security sensors of various types to detect whether the interior has been accessed. For instance, a light sensor may be provided within main cabinet 104 to detect a change in light-levels when door 106 is opened and/or an accelerometer may be attached to door 106 to detect when door 106 is opened.

Gaming machine 102 may include any number of user interface devices that convey sensory information to a user and/or receive input from the user. For example, gaming machine 102 may include electronic displays 110, 122, speakers 126, and/or a candle device 112 to convey information to the user of gaming machine 102. Gaming machine 102 may also include a console 124 having one or more inputs 134 (e.g., buttons, track pads, etc.) configured to receive input from a user. In one embodiment, display 110 and/or display 122 may also be a touch screen display configured to receive input from a user. A controller (not shown) within gaming machine 102 may run a game, such as a wager-based game, in response to receiving input from a user via inputs 134, display 122, or display 110. For example, inputs 134 may be operated to place a wager in the game and to run the game. In response, the controller may cause reels shown on display 122 to spin, such as with a software-based slot game.

Gaming machine 102 may also include devices for conducting a wager-based game. For example, gaming machine 102 may include a ticket acceptor 116 and a printer 120. In various embodiments, gaming machine 102 may be configured to run on credits that may be redeemed for money and/or other forms of prizes. Ticket acceptor 116 may read an inserted ticket having one or more credits usable to play a game on gaming machine 102. For example, a player of gaming machine 102 may wager one or more credits within a video slot game. If the player loses, the wagered amount may be deducted from the player's remaining balance on gaming machine 102. However, if the player wins, the player's balance may be increased by the amount won. Any remaining credit balance on gaming machine 102 may be converted into a ticket via printer 120. For example, a player of gaming machine 102 may cash out of the machine by selecting to print a ticket via printer 120. The ticket may then be used to play other gaming machines or redeemed for cash and/or prizes. According to various embodiments, gaming machine 102 may record data regarding its receipt and/or disbursement of credits. For example, gaming machine 102 may generate accounting data whenever a result of a wager-based game is determined. In some embodiments, gaming machine 102 may provide accounting data to a remote data collection device, allowing the remote monitoring of gaming machine 102.

In one embodiment, gaming machine 102 may include a loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing gaming machine 102. For example, a user having a loyalty account may be given a bonus turn on gaming machine 102 or credited loyalty points for playing gaming machine 102. Such loyalty points may be exchanged for loyalty rewards (e.g., a free meal, a free hotel stay, free room upgrade, discounts, etc.).

Figure 2:
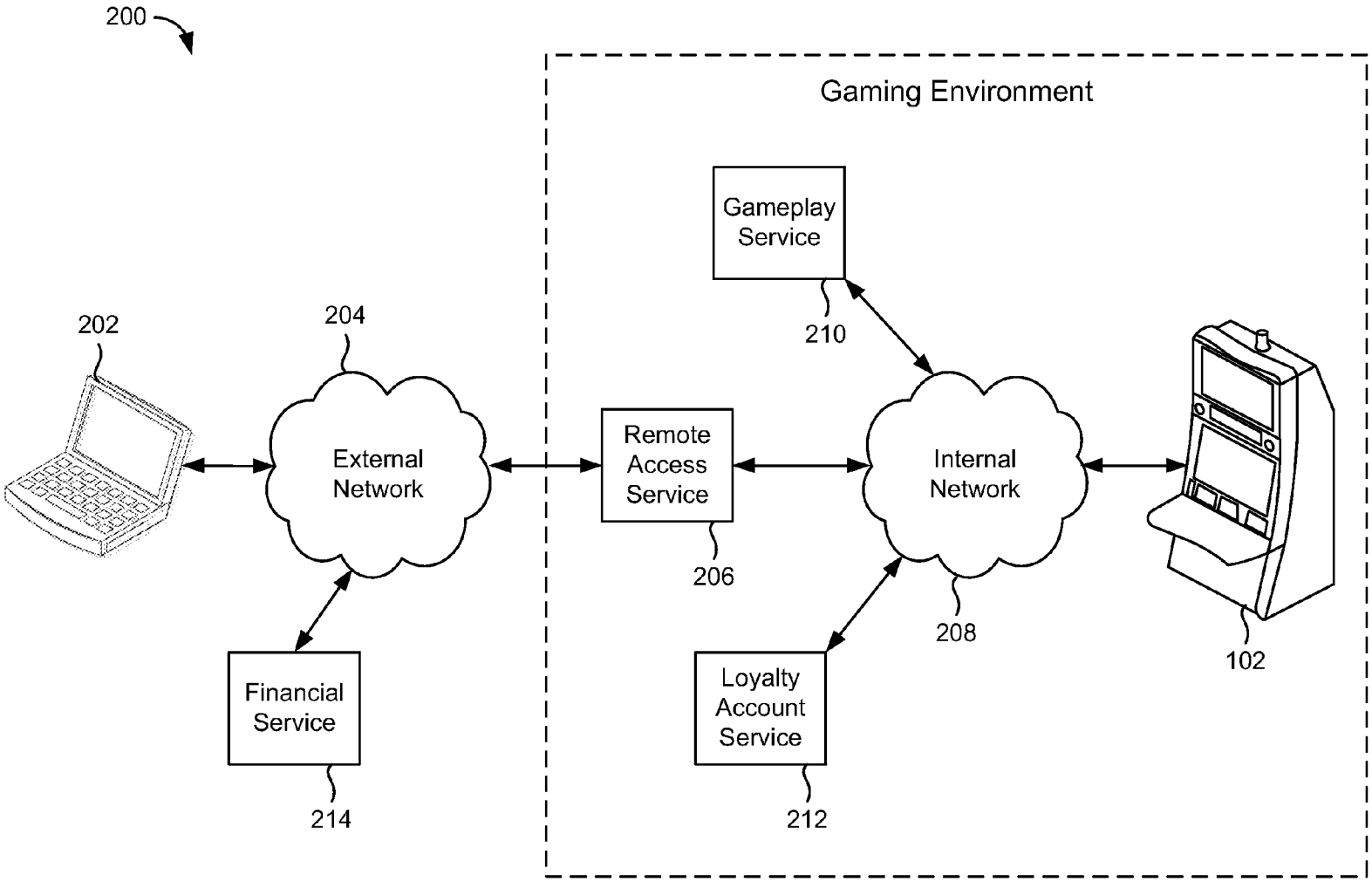
FIG. 2 is an illustration of a remote gaming system, according to an exemplary embodiment.

Referring now to FIG. 2, an illustration of a remote gaming system 200 is shown, according to an exemplary embodiment. Remote gaming system 200 is configured to allow the remote control of a gaming machine, such as gaming machine 102 shown in FIG. 1, from outside of a gaming environment by a client device 202. The gaming environment may be, for example, a casino, a racetrack, a hotel, another form of gaming environment, or a portion thereof (e.g., a casino floor, a gaming room of a racetrack, etc.). Remote gaming system 200 may be configured such that the user of client device 202 is able to issue the same or substantially the same commands to gaming machine 102 as the player would be able to if physically operating gaming machine 102.

Client device 202 may be any form of consumer electronic device configured to communicate via a external network 204. For example, client device 202 may be, but is not limited to, a laptop or desktop computer, a tablet device, an e-reader, a smartphone, a video game console, combinations thereof, or the like. Client device 202 may include one or more processors and one or more memories connected thereto that store instructions that are executed by the one or more processors. Exemplary forms of processors include microprocessors, application specific integrated circuits (ASICs), field programmable gate arrays (FPGAs), and combinations thereof. Exemplary memory devices may include, but are not limited to, electronic, optical, magnetic, or any other storage or transmission device capable of providing a processor with stored machine instructions. In some implementations, client device 202 may execute a stored web browser application to access gaming machine 102. For example, access to gaming machine 102 may be allowed through a web-based application, such as a Flash application or via streaming video. In further implementations, client device 202 may execute a stand-alone application to access gaming machine 102 (e.g., an application specifically configured to communicate with electronic devices associated with the gaming environment).

External network 204 may be any form of communication network that conveys data between client device 202 and a remote access service 206. External network 204 may include any number wired or wireless connections, in various embodiments. For example, client device 202 may communicate with remote access service 206 over a wired connection that includes a serial cable, a fiber optic cable, a CAT5 cable, or any other form of wired connection. In another example, client device 102 may communicate with remote access service 206 via a wireless connection (e.g., via WiFi, cellular, radio, etc.). External network 204 may also include any number of local area networks (LANs), wide area networks (WANs), or networking devices that form the Internet. Accordingly, external network 204 may include any number of intermediary networking devices, such as routers, switches, servers, etc.

According to various embodiments, remote access service 206 is configured to provide a bridge between external network 204 and electronic devices connected to an internal network 208. Internal network 208 may be located within the gaming environment and may be isolated from external network 204. For example, gaming machine 102 may be able to directly communicate with any device located on internal network 208, but may be prevented from accessing the Internet or other devices outside of the gaming environment. Similar to external network 204, internal network 208 may include any number of networking devices, such as switches, servers, routers, or the like. Internal network 208 may also include any number of wireless and/or hardwired connections between its devices. In various embodiments, internal network 208 and the devices connected thereto are configured to utilize a networking protocol specifically developed for use in a gaming environment. In one embodiment, the networking protocol may be the Game to System (G2S) protocol and/or System to System (S2S) protocol promulgated by the Gaming Standards Association. For example, gaming machine 102 may communicate with a gameplay service 210 on internal network 208 using the G2S protocol. In another embodiment, some or all of the devices on internal network 208 may utilize the Slot Accounting System (SAS) protocol developed by IGT. In further embodiments, internal network 208 may include protocol converters configured to translate data from one protocol into another. For example, a G2S<->SAS converter may convert a G2S message from gameplay service 210 into an SAS message for use by gaming machine 102 and vice-versa. The devices connected to internal network 208 may also utilize a higher level communication protocol, such as the Streaming Text Oriented Protocol (STOMP), in conjunction with a gaming protocol, such as G2S. For example, gameplay service 210 or another device on internal network 208 may execute a STOMP message broker that sends STOMP messages between gameplay service 210 and gaming machine 102. Such a message may be interpreted by gaming machine 102 as a remote command and, in response, perform the corresponding operation (e.g., increase or decrease a wagered amount, initiate a round of gameplay, etc.).

Remote access service 206 may be configured to employ any number of security measures to prevent malicious access to the devices on internal network 208. In some embodiments, remote access service 206 may be configured to screen incoming data from external network 204 for Trojans, viruses, root kits, or other forms of malicious software. Remote access service 206 may store and verify login credentials from client device 202 before allowing client device 202 to access a device on internal network 208 (e.g., a user name, password or passphrase, etc.). In some cases, remote access service 206 may also require a PIN or other identifier sent to a different device than client device 202. For example, remote access service 206 may require a PIN sent as a text message to a user's phone in addition to a user name and password, before allowing access to internal network 208. Communications between remote access service 206 and any device on external network 204 may also be encrypted, in some embodiments.

Remote gaming system 200 may include a gameplay service 210 configured to issue commands to gaming machines connected to internal network 208, such as gaming machine 102. In various embodiments, gameplay service 210 relays and/or converts gaming machine commands from remote access service 206 to gaming machine 102. In other words, gameplay service 210 may itself act as a bridge between remote access service 206 and gaming machine 102, thereby creating a second layer of security before gaming machine 102 is remotely controlled. Gameplay service 210 may also utilize some or all of the security measures implemented by remote access service 206. For example, a player operating client device 102 may issue a command to remote access service 206, remote access service 206 may validate the command and forward it to gameplay service 210, and gameplay service 210 may perform its own validation on the command before issuing the command to gaming device 102.

Commands issued by gameplay service 210 to gaming machine 102 may cause gaming machine 102 to perform some or all of the operations that gaming machine 102 would perform in response to input from a player physically present at gaming machine 102. For example, a gaming command issued by gameplay service 210 may cause gaming machine 102 to increase or decrease a wagered amount, begin a round of gameplay (e.g., by spinning reels, dealing cards, etc.), cash out of the machine, and so on. In some embodiments, gaming machine 102 may be configured, via installed software, to receive and perform remote commands from gameplay service 210. In further embodiments, gaming machine 102 may be outfitted with a hardware-based converter that converts commands from gameplay service 210 into signals that mimic input devices of gaming machine 102 (e.g., a signal from a "spin" button, a signal from a button to increase or decrease a wager, etc.).

In some embodiments, gameplay service 210 may determine which gaming machines on internal network 208 are available for remote play. For example, gameplay service 210 may poll gaming machine 102 as to whether or not gaming machine 102 is currently in use by a remote user and/or a player physically operating gaming machine 102. Gameplay service 210 may provide a listing of gaming machines available for remote play to client device 202. For example, the user of client device 202 may be able to select which gaming machine located on internal network 208 he or she wishes to play. In some embodiments, gaming machine 102 may provide an indication to a local user that the machine is currently in use by a remote user. For example, gaming machine 102 may display an "in use" screen while client device 202 is remotely playing gaming machine 102. In other embodiments, gaming machine 102 may be configured to allow remote and local gameplay in parallel.

In addition to issuing gaming commands to gaming machine 102, gameplay service 210 may also receive indications of gameplay results from gaming machine 102. For example, gameplay service 210 may receive a screen capture of a display of gaming machine 102, a video stream of a display of gaming machine 102, audio data from gaming machine 102, or any other indication of gameplay results (e.g., which symbols appeared on slot reels, which cards were drawn, etc.). In response, gameplay service 210 may relay the data to client device 202 via remote access service 206, thereby allowing the remote player to see the results of the gameplay and/or the gameplay in action (e.g., in real time, in near real-time, etc.).

Remote gaming system 200 may include a loyalty account service 212 that communicates with other devices in the gaming environment via internal network 208. Loyalty account service 212 may store account information for a remote player, such as the player operating client device 202. Exemplary account information may include, but is not limited to, information regarding the name of the player, the address of the player, the age or date of birth of the player (e.g., to prevent minors or other prohibited people from remotely playing a game), or contact information (e.g., one or more telephone numbers, an email address, etc.). Loyalty account service 212 may also store login information, such as the player's username and password. In various embodiments, loyalty account service 212, remote access service 206, or both working in conjunction, may validate an attempted login from a remote device.

In some embodiments, loyalty account service 212 may receive information regarding a player's gaming actions from gameplay service 210 or from gaming machine 102 itself. For example, loyalty account service 212 may receive information regarding the types of games the player plays, the amount the player wagers (e.g., in a given round of gameplay, on a per game basis, etc.), the results of a bonus round, and other such information. Loyalty account service 212 may award loyalty points or other rewards to a player's account based on the information received from gameplay service 210 or gaming machine 102. For example, a player may be awarded loyalty points that can be redeemed for prizes, meals, entertainment tickets, free game plays, etc. In one embodiment, loyalty account service 212 may analyze data regarding a player's gameplay history to determine a player's most likely preferences. For example, loyalty account service 212 may analyze the games most frequently played by the player to identify the player's favorite games or types of games.

Loyalty account service 212 may also store and associate financial information with a player's loyalty account. Financial information may be, but is not limited to, credit or debit card information, bank account information (e.g., a bank routing number, an account number, etc.), account information for Paypal, or the like. In general, the financial information associated with a player's loyalty account may be used by loyalty account service 212 to withdraw funds from the account for use in a wager-based game and/or to deposit any outstanding gaming funds into an account. As shown, loyalty account service 212 may communicate with a financial service 214 to add or subtract funds from an account. For example, loyalty account service 212 may initiate an electronic banking transaction with financial service 214 to withdraw funds from a player's bank account and credit the player's loyalty account with a corresponding amount of game credits. Similarly, loyalty account service 212 may initiate a funds transfer to add funds to a player's financial account when the player is finished playing the remote game, either automatically or in response to a request to do so from the user, in various embodiments. In some embodiments, any financial information stored by loyalty account service 212 may be hidden from view by the player operating client device 202. For example, the player may only be able to see the last four digits of his or her credit card when remotely accessing his or her loyalty account, thereby adding another layer of security to the player's financial information.

According to various embodiments, gameplay service 210, remote access service 206, and loyalty account service 212 may be implemented using one or more computing devices. Such a computing device includes one or more processors and one or more memories in communication with a processor. The memories store machine instructions that, when executed by the one or more processors, cause the computing device to perform the functions of gameplay service 210, remote access service 206, and/or loyalty account service 212. In some cases, multiple computing devices may be used to implement a service. For example, a group of computer servers in a datacenter may work together to implement one of services 206, 210, and 212. In further cases, the same computing device may implement two or more of remote access service 206, gameplay service 210, and loyalty account service 212. For example, the same server or set of servers may provide both gameplay service 210 and loyalty account service 212.

Figure 3:
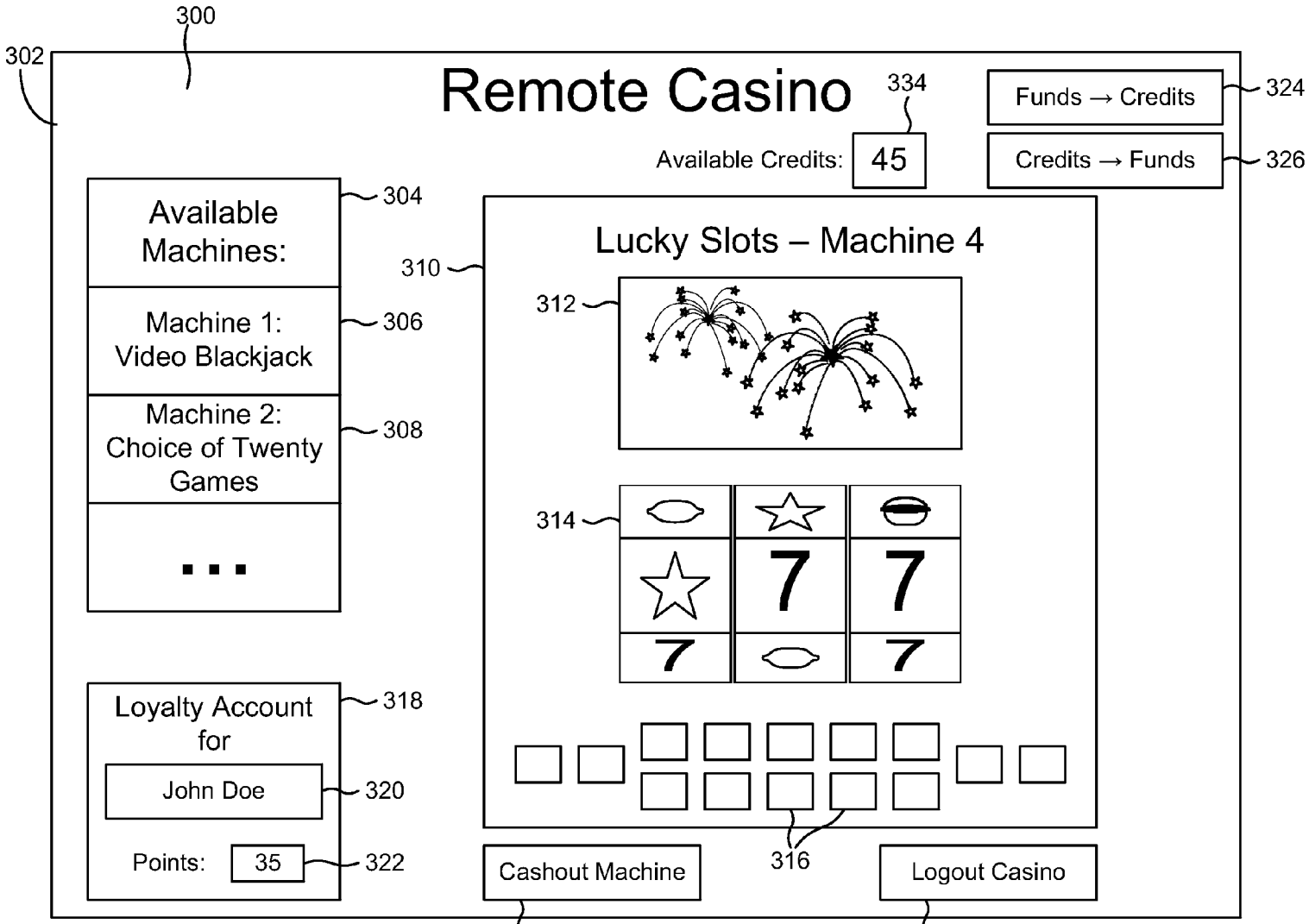
FIG. 3 is an illustration of a user interface for a remote gaming system, according to one embodiment.

Referring now to FIG. 3, an illustration of a user interface 300 for a remote gaming system is shown, according to one embodiment. As shown, user interface 300 may be provided to an electronic display 302 of a client device. In various embodiments, user interface 300 may be a webpage provided to the client device by the remote gaming system, a screen of a web-enabled application (e.g., a Flash application, an HTML5 application, etc.) provided to the client device, a thin-client executed by the client device, or a screen of a stand-alone application specifically configured to access a remote gaming environment. User interface 300 may generally provide an interface between the client device and one or more gaming machines located in the gaming environment. According to one embodiment, user interface 300 may be provided by, or communicate with, a remote access service of the gaming environment that provides a bridge between an external network and a network internal to the gaming environment. For example, the remote access service may communicate with the client device via the Internet and with other devices located within the gaming environment via a LAN.

User interface 300 may include an area 304 in which available gaming machines are listed. In one embodiment, the gaming machines are physical gaming machines located within the gaming environment. For each available gaming machine, the games available at that machine may also be displayed on user interface 300. For example, an indication 306 may be displayed that indicates that a video blackjack game is available for play at a first gaming machine. Similarly, an indication 308 may be displayed that indicates that a choice of games is available at a second gaming machine. For example, the gaming machine may allow a player to select one of twenty games available for play. Selection of indication 308 (e.g., by a mouse, pointing device, touch screen, etc.) may cause a listing of the available games to be displayed. Any number of different gaming machines may be indicated in area 304 (e.g., a first through nth gaming machine) based on the player's access privileges, whether a particular machine is in use by another, or other factors. In other embodiments, user interface 300 may not provide any indication of the player operating a physical gaming machine (e.g., a "real" gaming machine located in a gaming environment) or may not provide an indication of which gaming machines are available for remote play.

In some embodiments, the gaming machines listed in area 304 may be sorted, visually emphasized (e.g., by increasing the size of a font, using a different coloration or highlighting, etc.), visually deemphasized (e.g., by decreasing the size of a font, using a different coloration, etc.), or the like, based on a player's previous gameplay activity. For example, gaming machines having games or types of games that the player has played the most or most frequently may appear first in area 304. Other factors that may be used to determine how gaming machines are presented in area 304 include, but are not limited to, the most recently used games by the player, the games in which the player has wagered the most, games that are similar to those played by the player, and the like. A time window may also be used, in one embodiment, to phase out the effects of older games. For example, assume that a player heavily played a particular game but eventually lost interest in it. In such a case, the weighting given to that game may be decreased over time.

On selection of an available gaming machine, user interface 300 may present a representation of the gaming machine in screen area 310. According to various embodiments, screen area 310 may include some or all of the graphic displays of the corresponding physical gaming machine. For example, assume that the player operating user interface 300 has selected gaming machine 102 shown in FIG. 1. In such a case, screen area 310 may include a first portion 312 which corresponds to display 110 of gaming machine 102 and a second portion 314 which corresponds to display 122 of gaming machine 102. Gaming machine 102 may then communicate the screens that would be presented on displays 110, 122 to user interface 300. For example, gaming machine 102 may send the display data to a gameplay service on a LAN at the gaming environment using a gaming protocol. In response, the gameplay service may forward the display data to a remote access service for transmittal to user interface 300 via the Internet. In a similar manner, audio data from the gaming machine may be provided from the gaming machine to the client device displaying user interface 300 for play be one or more speakers of the client device.

Screen area 310 may also, in some embodiments, include inputs 316 which correspond to inputs 134 of the physical gaming machine 102. Inputs 316 may be, but are not limited to, inputs that increase or decrease a wagered amount, initiate a round of gameplay (e.g., by causing slot reels to spin, by causing cards to be dealt, etc.), begin a bonus round of play, or ask for help from an attendant. When the player is finished playing the selected gaming machine, he or she may select an input button 330 on user interface 300 to cash out of the current gaming machine. In other embodiments, button 330 may be included in inputs 316 and representative of a physical cashout button on the gaming machine.

According to alternative embodiments, screen area 310 may be populated using a normal online gaming interface. For example, assume that a slot game is available on a physical gaming machine but also has a corresponding online game. In such a case, screen area 310 may utilize the interface of the online game instead of providing a direct feed of the physical gaming machine's display to screen area 310. Different graphics may also be used in screen area 310 than on the physical gaming machine, in some cases. For example, displays 110, 122 of physical gaming machine 102 may be high definition displays, while the display of the client device may be a low definition display. In such a case, lower definition graphics may be provided instead to screen area 310 on the client device.

User interface 300 may also include an area 318 for loyalty account information. For example, area 318 may include an indication 320 of the player's name or an indication 322 of the number of loyalty points accrued by the player. Other exemplary forms of account information that may be displayed via user interface 300 may include data regarding the player's contact information or preferences. In some cases, the player's financial information (e.g., credit cards, bank accounts, etc. tied to the player's loyalty account) may be partially displayed, such as a partially concealed credit card or bank account number.

User interface 300 may include an indication 334 of the player's available gaming credits, which may be used in a wager-based gamine via one of the gaming machines listed in area 304. For example, the player may have 45 available credits, which correspond to $45 U.S. dollars. The number of available credits to a player may be increased or decreased by any of the following: the player converting funds from a financial account (e.g., bank account, credit card, etc.) into gaming credits, the player converting some or all of the gaming credits back into funds to be deposited into a financial account, the player placing a wager in a game, or the player winning an amount in a game. In some embodiments, user interface 300 includes input field 324, which is configured to allow the player to explicitly convert funds from a linked financial account into gaming credits. Similarly, user interface 300 may include input 326 which is configured to allow the player to convert gaming credits into funds to be transferred to a linked financial account. For example, selection of input 324 may cause a specified amount of funds to be withdrawn from a player's bank account in exchange for gaming credits. In some embodiments, the remote gaming system may automatically convert gaming credits into funds, without first selecting input 326. In one embodiment, the system may automatically add funds to a player's bank account, debit account, etc., in response to the player selecting button 330 to cash out of a particular gaming machine. In another embodiment, the system may automatically convert any remaining gaming credits back into funds in response to the player selecting a casino logout button 332. Casino logout button 332 is configured to cause user interface 300 to disconnect from the remote access service of the gaming environment.

While user interface 300 is depicted in FIG. 3 as a single screen, the screen areas indicia, and inputs of user interface 300 may be implemented using any number of different screens, menus, and windows, according to other embodiments. For example, inputs 324, 326 may be part of a separate menu or window devoted to the management of the player's funds. In another example, screen area 304 may be part of a separate screen that lists the gaming machines available to the player. In a further example, screen area 318 may be part of a separate window or screen devoted to the player's loyalty account.

Figure 4:
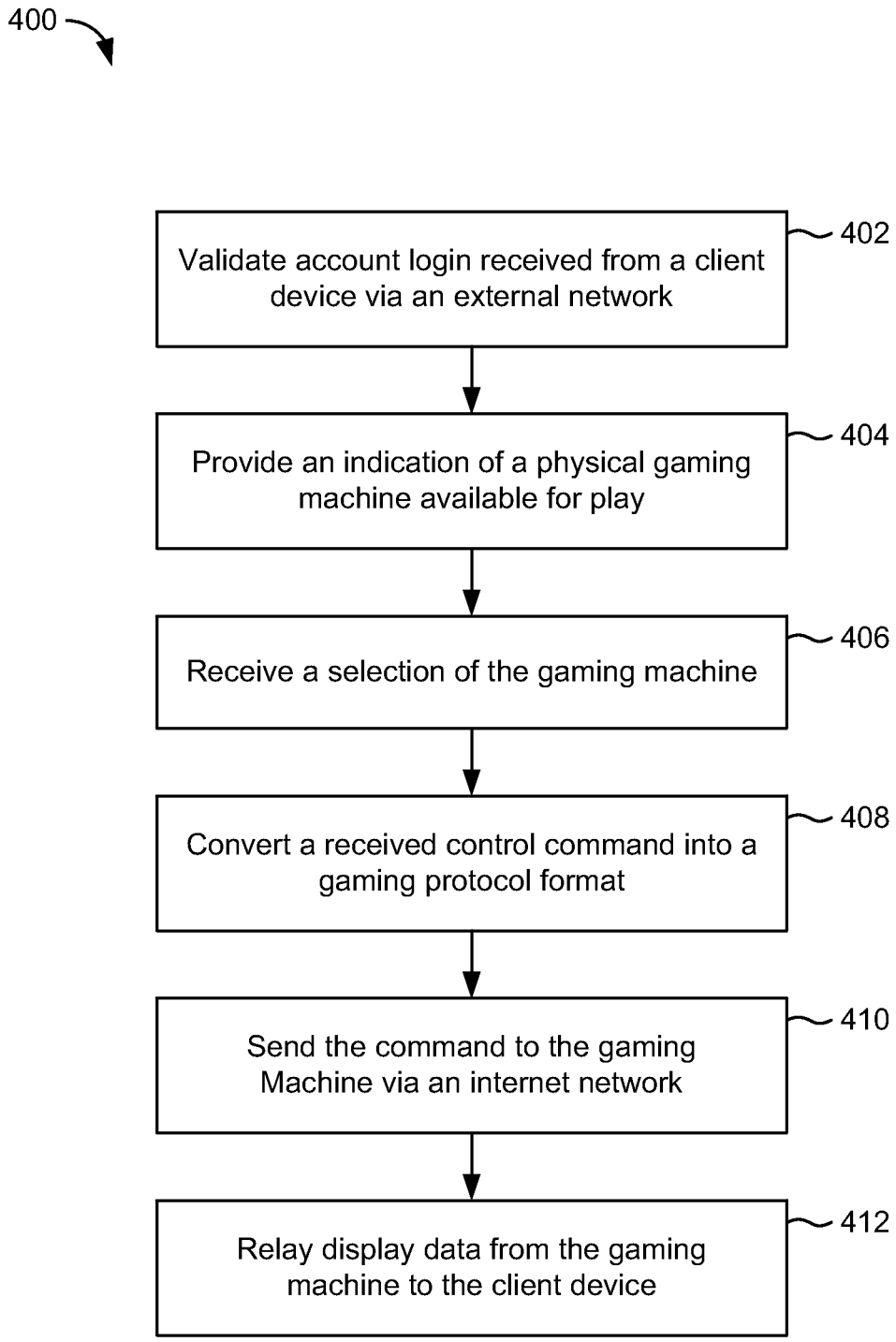
FIG. 4. is a flow diagram of a process for remotely controlling a gaming machine, according to an exemplary embodiment.

Referring now to FIG. 4, a flow diagram of a process 400 for remotely controlling a gaming machine, according to an exemplary embodiment. Process 400 may be implemented using one or more computing devices, such as those of remote access service 206, gameplay service 210, and loyalty account service 212 shown in FIG. 2. In general, process 400 allows a physical gaming machine located in a gaming environment (e.g., a casino, a racetrack, etc.) to be controlled remotely by a player via the Internet.

Process 400 includes validating account login data received from a client device via an external network (step 402). Account login data may include, but is not limited to, a screen name, a password or pass phrase, an answer to a security question, a PIN, or the like. The account login data may be validated by matching the received login data to stored account data for a player's account. For example, the provided screen name and password may be matched to that of a player's loyalty account. In various embodiments, the external network may be the Internet or another outward facing network from the perspective of the gaming environment. In other words, the client device may be located anywhere in the world in some cases. In one embodiment, the login data may further be validated to restrict remote logins from certain locations. For example, login data may be denied from certain countries entirely if the local laws of those countries prohibit wager-based gaming or present a security risk. The location of the client device may be included in the login data explicitly by a user, determined automatically by the client device (e.g., using geopositioning or the like), or may be determined based on a network address of the client device, such as an IP address.

Process 400 includes providing an indication of a physical gaming machine available for play (step 404). Once the received login data has been validated, an indication of a gaming machine available for play in the gaming environment may be provided to the client device. In some cases, a gameplay service may poll gaming machines located in the gaming environment to determine whether a particular gaming machine is in use (e.g., by a remote player or a player in the same location as the gaming machine). The gaming machines may be polled periodically or in response to a request for available gaming machines received from the client device. For example, a player may operate a user interface of the client device to request a listing of all available gaming machines or a subset of available gaming machines based on any number of specified filters (e.g., the types of games available for play, minimum or maximum wager amounts, etc.). In some embodiments, the indication of the available gaming machine may be configured to emphasize or deemphasize the gaming machine based on a history of gameplay associated with the player's account.

Process 400 includes receiving a selection of the gaming machine (step 406). The selection of the gaming machine may be received either directly or indirectly, according to various embodiments. In one example, assume that a graphical user interface presented to the player at the client device includes an indication that the gaming machine is available for play. In response to the player selecting the gaming machine to initiate gameplay, the client device may provide the selection to a remote access service of the gaming environment which then forwards the selection to a gameplay service and/or to the selected gaming machine.

Process 400 includes converting a received control command into a gaming protocol format (step 408). While a physical gaming machine is in use by a client device, the remote device may communicate control commands to a remote access service of the gaming environment. For security reasons, the gaming machine may itself be on an internal network that is isolated from the Internet or other external networks. In many gaming environments, such an internal network may utilize a communications protocol that is specifically designed for gaming machines, such as the G2S protocol. A command received from the client device may be converted into the format for a gaming protocol and forwarded to the gaming machine. In some embodiments, a higher level messaging protocol, such as STOMP, may be used on top of the gaming protocol to communicate the command to the gaming machine.

Process 400 includes sending the control command to the gaming machine via an internal network (step 410). As noted previously, devices on the internal network may be communicatively isolated from a network outside of the gaming environment, such as the Internet. Such an internal network may also utilize a gaming protocol that differs from standard Internet protocols and is designed specifically for communicating with gaming machines. After conversion of a remote command received from the client device into a gaming protocol, the converted control command may then be forwarded to the gaming machine via the internal network. In response to receiving the command, the gaming machine may perform the corresponding operation (e.g., increasing or decreasing a wagered amount, initiating a new round of gameplay, etc.). According to various embodiments, remote commands may be implemented to perform some or all of the same operations available to a player that is physically playing the gaming machine.

Process 400 includes relaying display data from the gaming machine to the client device (step 412). In cases in which the gaming machine is located on an internal network that differs from the external network on which the client device communicates, the display data from the gaming machine may be relayed to the client device via a remote access service that acts as a bridge between the internal and external networks. The display data may include real-time video data, screen captures taken periodically, or display data sent to a thin client on the gaming machine. During remote gameplay, the gaming machine may display the same display data sent to the client device or may display a screen indicating that the gaming machine is currently in use by a remote user. In some embodiments, the display data may be converted from a gaming protocol used in the internal network into another protocol used in the external network. Audio data may also be communicated from the gaming machine to the client device in a similar manner, in some implementations.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" include all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming system, said method comprising:

(a) monitoring a plurality of gaming machines located in a gaming environment for in-person play, each of said gaming machines associated with a credit balance that is: (i) increasable via an acceptor of a physical item associated with a monetary value, and (ii) decreasable via a cashout device configured to receive an input to cause an initiation of a payout associated with the credit balance;

(b) selecting, from among the plurality of monitored gaming machines, one of the gaming machines for remote play;

(c) communicating, via a remote access service configured to bridge an internal network of the gaming environment and an external network apart from the gaming environment, a non-gaming protocol command received from a client device to the selected gaming machine, the non-gaming protocol command being configured to cause the selected gaming machine to initiate a round of gameplay and the command being formatted, via a gameplay service, to a gaming protocol command; and (d) communicating a result of the gameplay from the selected gaming machine to the client device.

2. The method of claim 1, wherein the selected gaming machine includes one selected from the group consisting of: a slot machine, a video poker machine, and a video blackjack machine.

3. The method of claim 1, which includes:

validating player account login data received from the client device via the external network.

4. The method of claim 1, which includes:

providing an indication of the gaming machine being available for remote play to the client device.

5. The method of claim 1, wherein the gaming protocol includes a game to system protocol.

6. The method of claim 5, which includes:

converting the command into a simple text oriented messaging protocol message; and communicating the simple text oriented messaging protocol message to the selected gaming machine.

7. The method of claim 1, which includes:

preventing access to the selected gaming machine based on a location of the client device.

8. The method of claim 3, which includes:

associating a financial account with a player account;

requesting a transfer of funds from the financial account; and converting the requested funds into gaming credits usable by the selected gaming machine.

9. The method of claim 1, which includes:

causing the client device to display a user interface configured to display data from the selected gaming machine.

10. The method of claim 9, wherein the user interface includes at least one of a webpage and a web-enabled application.

11. The method of claim 3, which includes:

associating a history of gameplay with a player account; and using the history of gameplay to suggest one or more gaming machines to the client device.

12. The method of claim 1, wherein the communicated command corresponds to a command associated with an input received by the gaming machine via a physical input device of the gaming machine.

13. A gaming system for providing remote access to a physical gaming machine located in a gaming environment comprising:

a plurality of physical gaming machines located in a gaming environment and configured for in-person play, each of said gaming machines including:

a housing, a plurality of input devices supported by the housing, said plurality of input devices including: (i) an acceptor, and (ii) a cashout device, and at least one processor configured to operate with the plurality of input devices to:

(i) if a physical item is received via the acceptor, cause a credit balance to be established based, at least in part, on a monetary value associated with the received physical item, and (ii) if a cashout input is received via the cashout device, cause an initiation of any payout associated with the credit balance; and at least one computing device configured to:

(a) select, from among the plurality of gaming machines, one of the gaming machines for remote play;

(b) communicate via a remote access service configured to bridge an internal network of the gaming environment and an external network apart from the gaming environment, a non-gaming protocol command received from a client device to the selected gaming machine, the non-gaming protocol command being configured to cause the selected gaming machine to initiate a round of gameplay and the non-gaming protocol command being formatted, via a gameplay service, to a gaming protocol command; and (c) communicate a result of the gameplay from the selected gaming machine to the client device.

14. The system of claim 13, wherein the at least one computing device is configured to:

preventing access to the selected gaming machine based on a location of the client device.

15. The system of claim 13, wherein the at least one computing device is configured to:

associate a financial account with a player account;

request a transfer of funds from the financial account; and convert the requested funds into gaming credits usable by the selected gaming machine.

16. The system of claim 13, wherein the at least one computing device is configured to:

cause the client device to display a user interface configured to display the display data from the selected gaming machine.

17. The system of claim 16, wherein the user interface includes at least one of a webpage and a web-enabled application.

18. The system of claim 13, wherein the at least one computing device is configured to:

associate a history of gameplay with a player account; and use the history of gameplay to suggest one or more gaming machines to the client device.

19. The system of claim 13, wherein the communicated command corresponds to a command associated with an input received by the gaming machine via a physical input device of the gaming machine.

20. A remote access system comprising:

a remote access service configured to provide a bridge between a network internal to a gaming environment and an external network located outside of the gaming environment; and a gameplay service configured to provide gaming protocol formatted commands to a gaming machine located in the gaming environment via the internal network of the gaming environment, said gaming machine including: a housing, a plurality of input devices supported by the housing, said plurality of input devices including: (i) an acceptor, and (ii) a cashout device, and at least one processor configured to operate with the plurality of input devices to: (i) if a physical item is received via the acceptor, cause a credit balance to be established based, at least in part, on a monetary value associated with the received physical item, and (ii) if a cashout input is received via the cashout device, cause an initiation of any payout associated with the credit balance, wherein the remote access service is configured to receive a gameplay command for the selected gaming machine from a client device via the external network and to forward the command to the gameplay service, wherein the gameplay service is configured to convert the command received from the remote access service into a gaming protocol format and to send the converted command to the selected gaming machine via the internal network of the gaming environment.

21. The remote access system of claim 20, wherein the gaming protocol is the game to system protocol.

22. The remote access system of claim 21, wherein the gameplay service is configured to:

convert the control command received from the remote access service into a simple text oriented messaging protocol message; and communicate the simple text oriented messaging protocol message to the selected gaming machine via the internal network.

23. The remote access system of claim 20, which includes a loyalty account service configured to maintain a loyalty account for a player, the loyalty account being associated with a financial account.

24. The remote access system of claim 23, wherein the loyalty account service is configured to send a request to transfer funds from the financial account to a financial service via the remote access service, and wherein the loyalty account service is configured to convert transferred funds into gaming credits for the loyalty account.

25. The remote access system of claim 23, wherein the loyalty account service is configured to receive an indication of gameplay from the gameplay service and to associate a history of gameplay with the loyalty account.

26. The remote access system of claim 23, wherein the loyalty account service is configured to validate account login data sent by the client device.

* * * * *